US011140506B2

(12) United States Patent
Aoki et al.

(10) Patent No.: US 11,140,506 B2
(45) Date of Patent: Oct. 5, 2021

(54) SOUND SIGNAL PROCESSOR AND SOUND SIGNAL PROCESSING METHOD

(71) Applicant: YAMAHA CORPORATION, Hamamatsu (JP)

(72) Inventors: Ryotaro Aoki, Hamamatsu (JP); Akihiko Suyama, Hamamatsu (JP); Tatsuya Fukuyama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/837,318

(22) Filed: Apr. 1, 2020

(65) Prior Publication Data

US 2020/0322746 A1 Oct. 8, 2020

(30) Foreign Application Priority Data

Apr. 3, 2019 (JP) ..... JP2019-071116

(51) Int. Cl.
*H04S 7/00* (2006.01)
*G10H 1/00* (2006.01)
*H04R 5/04* (2006.01)

(52) U.S. Cl.
CPC ..... *H04S 7/303* (2013.01); *G10H 1/0091* (2013.01); *H04R 5/04* (2013.01); *H04S 2400/13* (2013.01)

(58) Field of Classification Search
None
See application file for complete search history.

(56) References Cited

U.S. PATENT DOCUMENTS

| | | | | |
|---|---|---|---|---|
| 5,614,687 | A | 3/1997 | Yamada | |
| 2003/0174845 | A1* | 9/2003 | Hagiwara | H04S 3/00 381/17 |
| 2014/0033902 | A1* | 2/2014 | Sasai | G10H 1/40 84/611 |
| 2015/0264502 | A1 | 9/2015 | Aoki | |
| 2016/0125867 | A1 | 5/2016 | Jarvinen | |
| 2017/0263230 | A1* | 9/2017 | Takehisa | G10H 1/053 |
| 2020/0043453 | A1* | 2/2020 | Lang | G10H 1/0008 |

FOREIGN PATENT DOCUMENTS

| | | | |
|---|---|---|---|
| EP | 1347668 | A2 | 9/2003 |
| JP | 2014103456 | A | 6/2014 |

OTHER PUBLICATIONS

Extended European Search Report issued in European Appln. No. 20167831.5 dated Jul. 10, 2020.
Office Action issued in Chinese Appln. No. 202010185419.4 dated Mar. 5, 2021. English machine translation provided.

* cited by examiner

*Primary Examiner* — Paul W Huber
(74) *Attorney, Agent, or Firm* — Rossi, Kimms & McDowell LLP

(57) ABSTRACT

A sound signal processor includes a memory storing instructions and a processor configured to implement the stored instructions to execute a plurality of tasks, the tasks including a sound signal input task configured to obtain a sound signal, a beat detection task configured to detect a beat in the sound signal, and a processing task configured to perform an effect processing on the sound signal in accordance with a timing of the detected beat.

18 Claims, 7 Drawing Sheets

SOUND SIGNAL PROCESSOR AND SOUND SIGNAL PROCESSING METHOD

CROSS REFERENCE TO RELATED APPLICATION

This application is based upon and claims the benefit of priority of Japanese Patent Application No. 2019-071116 filed on Apr. 3, 2019, the contents of which are incorporated herein by reference in its entirety.

BACKGROUND OF THE INVENTION

1. Field of the Invention

An embodiment of this invention relates to a sound signal processor that performs various processing on a sound signal.

2. Description of the Related Art

JP-A-2014-103456 discloses an audio system that localizes a sound source in a position specified by the user through a mobile terminal such as a smartphone. The mobile terminal detects information about a posture of the own terminal and transmits it to the audio system together with position information about a placement position of the sound source desired by the user. The audio system localizes the sound source based on the received information, and generates audio signals to be supplied to respective speakers. According to such technical contents, the placement position of the sound source can be moved in real time by changing the posture of the mobile terminal.

However, it is complicated and difficult for the user to manually control the placement position of the sound source.

SUMMARY OF THE INVENTION

An object of this invention is to provide a sound signal processor capable of automatically controlling processing on a sound signal of a sound source.

A sound signal processor according to an aspect of the present invention includes a memory storing instructions and a processor configured to implement the stored instructions to execute a plurality of tasks, the tasks including a sound signal input task configured to obtain a sound signal, a beat detection task configured to detect a beat in the sound signal, and a processing task configured to perform an effect processing on the sound signal in accordance with a timing of the detected beat.

According to the above-described aspect, the sound signal processor is capable of automatically performing control since effect processing is performed on the sound signal in accordance with the timing of the beat contained in the sound signal.

DETAILED DESCRIPTION OF THE EXEMPLARY EMBODIMENTS

Figure 1:
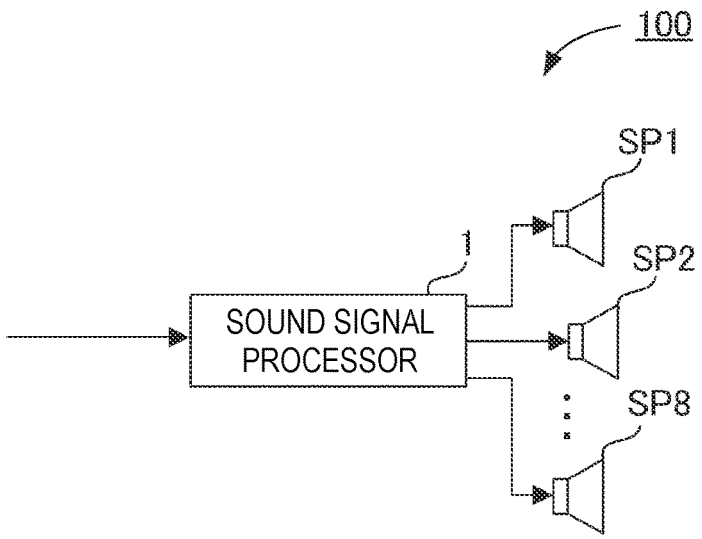
FIG. 1 is a block diagram showing a structure of a sound signal processing system according to an embodiment of the present invention.
Figure 2:
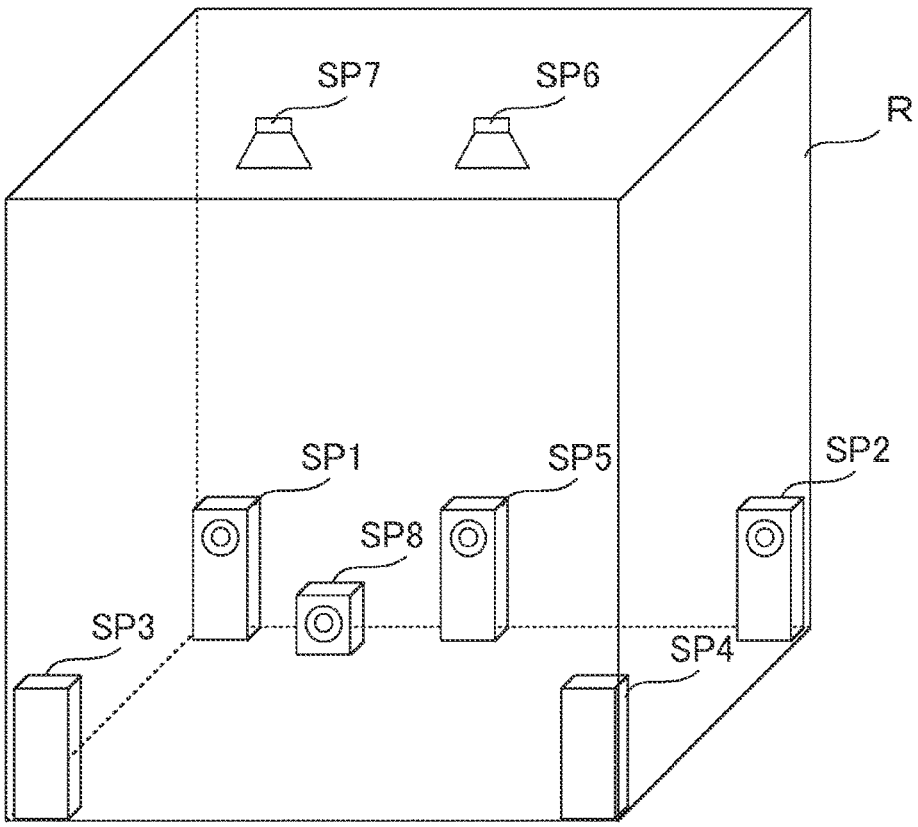
FIG. 2 is a schematic view of a listening environment in the embodiment of the present invention.

FIG. 1 is a block diagram showing a structure of a sound signal processing system 100 according to an embodiment of the present invention. FIG. 2 is a schematic view of a listening environment in the embodiment of the present invention. The sound signal processing system 100 includes a sound signal processor 1 and a plurality of speakers, for example, eight speakers SP1 to SP8. The sound signal processor 1 is a device such as a personal computer, a set-top box, an audio receiver, a mobile device or a powered speaker (a speaker with built-in amplifier).

In the present embodiment, as an example, the listening environment is a rectangular parallelepiped room R. The speakers SP1 to SP8 are placed in the room R. The speaker SP1 and the speaker SP2 are front speakers which are placed in both corners on one side of the floor of the room R. The speaker SP3 and the speaker SP4 are rear speakers which are placed in both corners on the other side of the floor of the room R. The speaker SP5 is a center speaker which is placed between the speaker SP1 and the speaker SP2. The speaker SP6 and the speaker SP7 are ceiling speakers which are placed on the ceiling of the room R. The speaker SP8 is a subwoofer which is placed near the speaker SP5. The speakers SP1 to SP8 are each connected to the sound signal processor 1.

Figure 3:
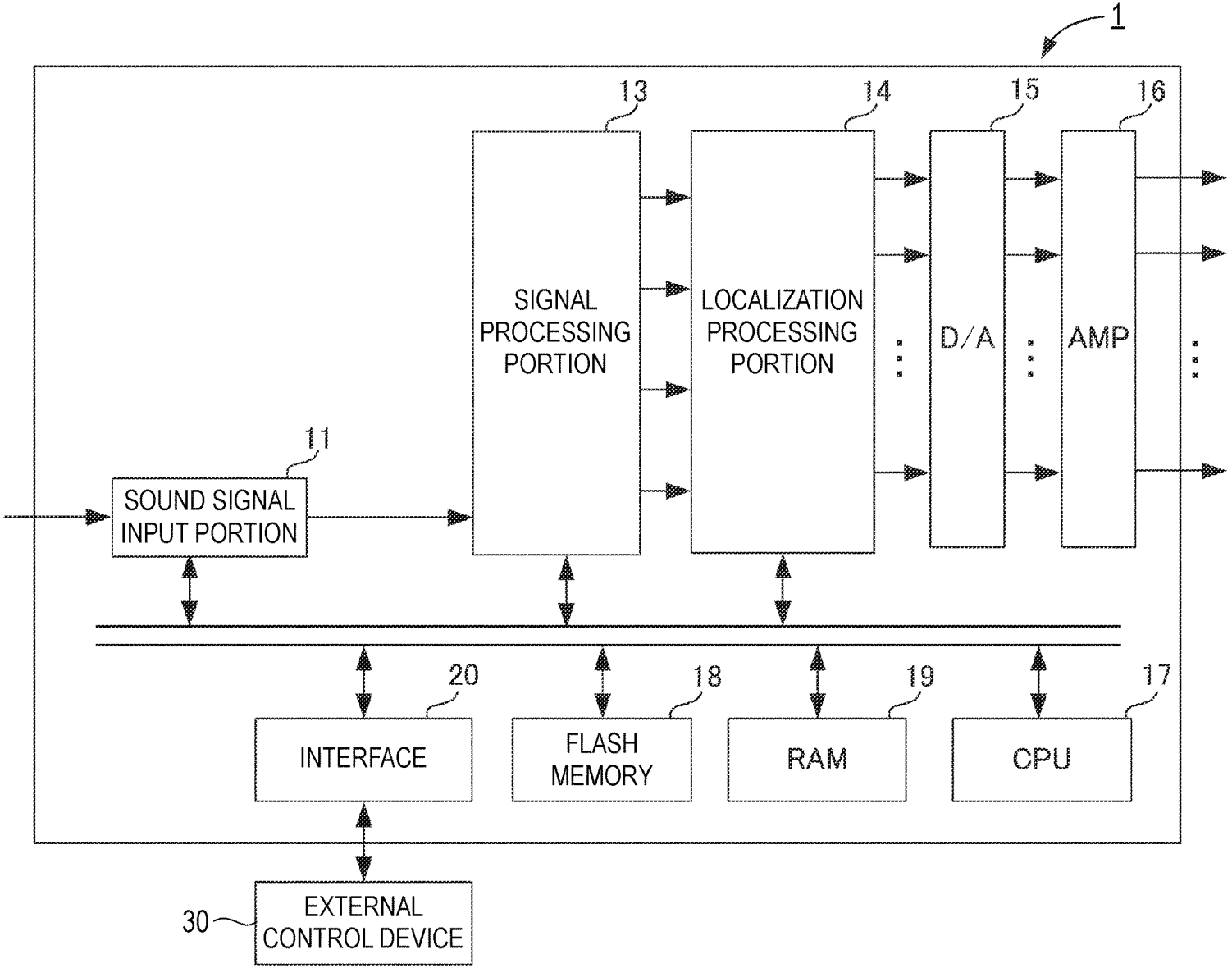
FIG. 3 is a block diagram showing a structure of a sound signal processor according to the embodiment of the present invention.

FIG. 3 is a block diagram showing a structure of the sound signal processor 1 according to the embodiment of the present invention. The sound signal processor 1 includes a sound signal input portion 11, a signal processing portion 13, a localization processing portion 14, a D/A converter 15, an amplifier (AMP) 16, a CPU 17, a flash memory 18, a RAM 19 and an interface 20.

The CPU 17 reads an operation program (firmware) stored in the flash memory 18 to the RAM 19, and integrally controls the sound signal processor 1.

The sound signal input portion 11 is, for example, an HDMI (trademark) interface, or a communication interface such as a network interface. In the present embodiment, the sound signal input portion 11 receives sound signals corresponding to a plurality of sound sources, and outputs them to the signal processing portion 13. Further, the sound signal input portion 11 outputs the sound signals to the CPU 17. Here, sound source information contained in the sound signals, for example, position information of respective sound sources and information such as the level information are also outputted to the CPU 17.

The signal processing portion 13 is configured by, for example, a DSP. In the present embodiment, the signal processing portion 13 performs signal processing such as delay, reverb or equalizer on the sound signal corresponding to each of sound sources according to the setting and an instruction of the CPU 17. After the signal processing, the sound signal corresponding to each of the sound sources is inputted to the localization processing portion 14.

The localization processing portion 14 is configured by, for example, a DSP. In the present embodiment, the localization processing portion 14 performs localization processing to localize a sound image according to an instruction of the CPU 17. The localization processing portion 14 distributes sound signals corresponding to each sound source to the speakers SP1 to SP8 with predetermined gains so that the sound images are localized in positions corresponding to the position information of respective sound sources specified by the CPU 17. The localization processing portion 14 inputs the sound signals corresponding to the speakers SP1 to SP8 to the D/A converter 15.

The D/A converter 15 converts the sound signals corresponding to the speakers SP1 to SP8 into analog signals. The amplifier 16 amplifies the analog sound signals corresponding to the speakers SP1 to SP8, and inputs them to the speakers SP1 to SP8.

In the above-described embodiment, the sound signal input portion 11 obtains sound signals corresponding to a plurality of sound sources, and outputs them directly to the signal processing portion 13. However, in another embodiment, a decoder (not shown) may be further provided between the sound signal input portion 11 and the signal processing portion 13. The decoder is configured by, for example, a DSP. In such a structure, when the sound signal input portion 11 obtains contents data, the decoder decodes the contents data, and extracts a sound signal from the contents data. When the contents data is data conforming to the object base method, the decoder further extracts sound source information from the contents data. According to the object base method, a plurality of sound sources (objects) contained in contents are stored as independent sound signals. The decoder inputs the sound signals corresponding to the sound sources to the signal processing portion 13 and the CPU 17. The sound source information contains information such as the position information and the levels of the sound sources. The decoder inputs the position information and the level information of the sound sources to the CPU 17.

The localization processing portion 14 performs effect processing related to a two-or-more-dimensional space on the sound signals, that is, processing to change the positions of the sound sources on a two-dimensional plane or in a three-dimensional space according to an instruction of the CPU 17. Moreover, the signal processing portion 13 performs signal processing such as delay, reverb or equalizer according to an instruction of the CPU 17. Accordingly, a DSP including the signal processing portion 13 and the localization processing portion 14, and the CPU 17 may be treated as one processing portion. The signal processing portion 13, the localization processing portion 14 and the decoder may be implemented in one DSP by means of software, or may be implemented by individual DSPs by means of hardware. In this embodiment, the signal processing portion 13 and the localization processing portion 14 perform effect processing (sound source position change and signal processing) for each of the sound sources, on the sound signals corresponding to a plurality of sound sources.

Figure 4:
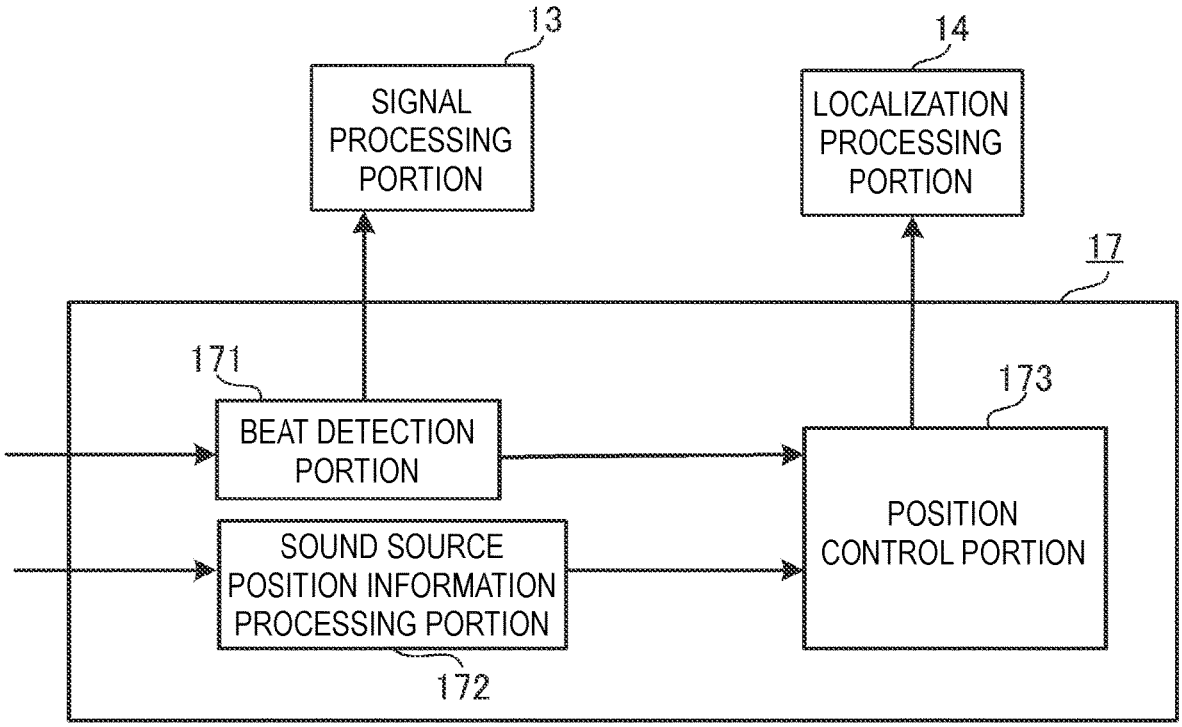
FIG. 4 is a block diagram showing a functional structure of a CPU according to the embodiment of the present invention.
Figure 5:
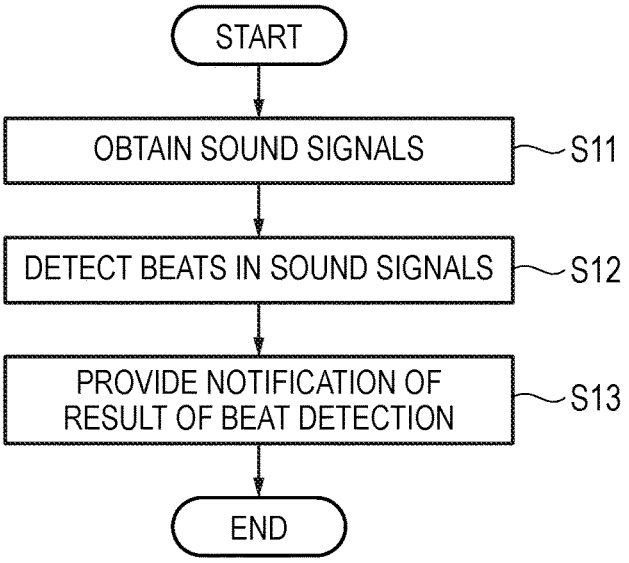
FIG. 5 is a flowchart showing an operation of the CPU according to the embodiment of the present invention.

FIG. 4 is a block diagram showing a functional structure of the CPU 17 according to the embodiment of the present invention. In this embodiment, the CPU 17 functionally includes a beat detection portion 171, a sound source position information processing portion 172 and a position control portion 173. FIG. 5 is a flowchart showing an operation of the CPU 17 according to the embodiment of the present invention. These functions are implemented by a program of the CPU 17. The beat detection portion 171, the sound source position information processing portion 172, the position control portion 173 and the localization processing portion 14 are an example of the processing portion.

In this embodiment, the beat detection portion 171 obtains sound signals from the sound signal input portion 11 (S11). After obtaining the sound signals corresponding to a plurality of sound sources, the beat detection portion 171 detects beats from the sound signals (S12). The beat detection portion 171 may perform beat detection on the sound signal corresponding to a specific sound source or may perform beat detection on all the sound signals. The beat detection portion 171, for example, calculates the amplitude average value of the sound signal per unit time, and compares the calculated amplitude average value with the amplitude values of the sound signals. A beat is detected when the amplitude value of a sound signal is higher than the amplitude average value by not less than a certain degree (for example, not less than +6 dB). However, a threshold value of beat detection is not limited to +6 dB. Moreover, the beat detection method is not limited to the above-described method.

When beat detection is finished, the beat detection portion 171 notifies the signal processing portion 13 of the result of the beat detection (S13). To be specific, the beat detection portion 171 notifies the signal processing portion 13 of the positions of the detected beats, that is, the timing where the beats are detected within the sound signals. Then, in accordance with timings of the detected beats, the signal processing portion 13 performs signal processing, for example, processing to adjust the depth of the reverb and the delay on the sound signals. That is, the signal processing portion 13 changes the depth of the reverb and the length of the delay for each timing of beat detection. In this embodiment, the signal processing portion 13 performs signal processing for each sound source, on the sound signals corresponding to a plurality of sound sources.

As an example of the signal processing, the signal processing portion 13 adjusts the volume of the sound signal in accordance with the timing of the detected beat. For example, the signal processing portion 13 increases the gain of the sound signal at the timing where the beat is detected, and decreases the gain of the sound signal at a timing other than the timing of the beat. That is, the signal processing portion 13 increases the level (volume) of a part of the sound signal where the beat is detected, and decreases the level of a part of the sound signal other than the part of the sound signal where the beat is detected.

As another example of the signal processing, the signal processing portion 13 replaces a sound signal of the sound source with a sound signal of another sound source which is different in kind from the sound source in accordance with the timing of the detected beat. To implement this processing, the CPU 17 further includes a sound signal generation portion (not shown). The sound signal generation portion previously generates the sound signal of the another sound source and sends it to the signal processing portion 13. Then, the signal processing portion 13 replaces an existing sound signal with the previously prepared sound signal of the another sound source in accordance with the result of the beat detection. In such processing, the sound signal processor 1 can create a new piece of music.

According to the above-described processing, when the speakers SP1 to SP8 output sounds based on the sound signals, various expressions with musicality can be performed.

Figure 6:
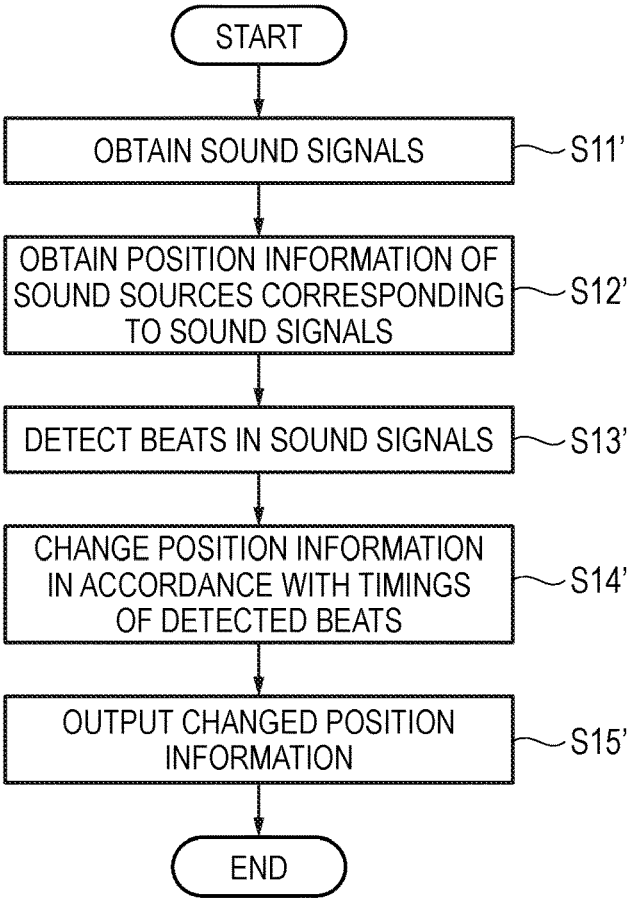
FIG. 6 is a flowchart showing an operation of the CPU according to the embodiment of the present invention.

FIG. 6 is a flowchart showing an operation of the CPU 17 according to the embodiment of the present invention. These functions are implemented by a program of the CPU 17. The beat detection portion 171 and the sound source position information processing portion 172 obtain sound signals from the sound signal input portion 11 (S11'). Then, the sound source position information processing portion 172 obtains position information of the sound sources corresponding to the sound signals (S12'), and the beat detection portion 171 detects beats from the sound signals (S13'). In this embodiment, the position information of the sound sources is obtained based on the sound signals inputted from the sound signal input portion 11. However, in another embodiment, in a case where the sound signal processor 1 has a decoder that decodes position information, the sound source position information processing portion 172 may obtain the position information of the sound sources directly from the decoder.

The position control portion 173 changes the position information of the sound sources in accordance with timings of the detected beats based on the result of the beat detection (S14'). As an example of the change of the position information of the sound sources, the position control portion 173 randomly moves the position of each of the sound sources. However, the change of the position information of the sound sources is not limited to the random one. As a second example, the position control portion 173 virtually rotates the position of each of the sound sources about a predetermined axis. As a third example, the position control portion 173 virtually moves the position of each of the sound sources upward or downward every beat detection. After changing the position information of the sound sources, the position control portion 173 outputs the changed position information to the localization processing portion 14 (S15').

The localization processing portion 14 performs localization processing to localize a sound image, based on the changed position information. That is, the localization processing portion 14 distributes the sound signal of each of the sound sources to the speakers SP1 to SP8 with a predetermined gain so that the sound image is localized in the position corresponding to the changed position information of each of the sound sources from the CPU 17 in accordance with the timings of the detected beats.

According to the above-described change of the sound image localization position of the sound source, when the speakers SP1 to SP8 output sounds based on the sound signals, various new expressions with musicality can be performed.

In the flowchart shown in FIG. 5, the signal processing is performed in accordance with the timings of the detected beats. In the flowchart shown in FIG. 6, the sound image localization position of each of the sound sources is changed in accordance with a timing of the detected beat. While in the above-described embodiment, the flows shown in FIGS. 5 and 6 are shown as two independent flows, in another embodiment, the CPU 17 is capable of simultaneously executing them. To be specific, the CPU 17 notifies the signal processing portion 13 of the result of the beat detection, and at the same time, changes the position information of the sound sources in accordance with the timings of the detected beats and outputs the changed position information to the localization processing portion 14. Doing this enables the signal processing portion 13 and the localization processing portion 14 to continuously execute signal processing and sound image localization on the sound signals in accordance with the timings of the detected beats.

Figure 7:
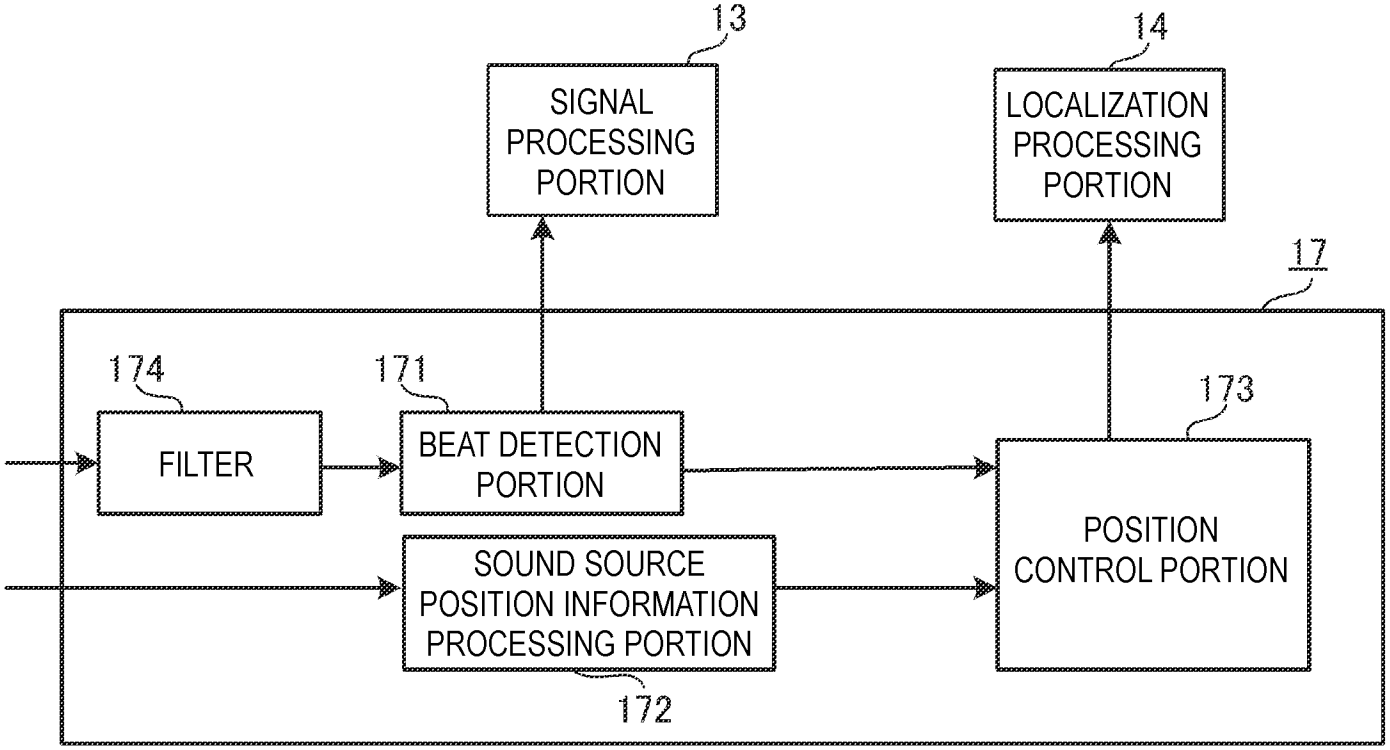
FIG. 7 is a block diagram showing the functional structure of the CPU according to another embodiment of the present invention.

FIG. 7 is a block diagram showing the functional structure of the CPU 17 according to another embodiment of the present invention. In this embodiment, the CPU 17 further includes a filter 174. The filter 174 which is a high-pass filter, a low-pass filter or a band-pass filter extracts a specific band of a sound signal. The beat detection portion 171 performs a beat detection on the specific band of the sound signal extracted by the filter 174. In such a structure, the CPU 17 separates a sound signal of a specific musical instrument from the sound source, and performs a beat detection on the sound signal of that musical instrument. Accordingly, the sound signal processor 1 further performs signal processing and effect processing such as sound source position change in accordance with the timing of the beat of the specific musical instrument.

In the above-described embodiment, the beat detection portion 171 performs a beat detection on a sound signal of a predetermined range (for example, one piece of music). However, in another embodiment, the beat detection portion 171 may detect beats in real time on sequentially inputted sound signals. The sound signal processor 1 can detect beats from sound signals and instantly perform effect processing in accordance with timings of the detected beats.

In the embodiment of the present invention, the sound signal processor 1 may output the result of the beat detection in real time or collectively to an external control device 30 or operation device through the interface 20 as illustrated in FIG. 1. The interface 20 may be a USB interface, an HDMI (trademark) interface, a network interface or the like. The external control device 30 is, for example, a lighting control device, a video system control device or the like. Accordingly, the external control device 30 can change the lighting effect and the video effect in accordance with the detected beats. Moreover, in the embodiment of the present invention, the sound signal processor 1 can accept input of an operation to change the sound source position where an effect is added, through the interface 20. Accordingly, the user of the operation device can change sound source positions and add an effect according to the result of the beat detection. For example, the user can concentrate on the management of another effect while leaving the sound source position change to the sound signal processor 1. Further, in the embodiment of the present invention, the sound signal processor 1 can accept input of an operation to change the threshold value of beat detection or the passband of the filter 174 through the interface 20. Accordingly, the user can change the setting related to the beat detection.

Figure 8:
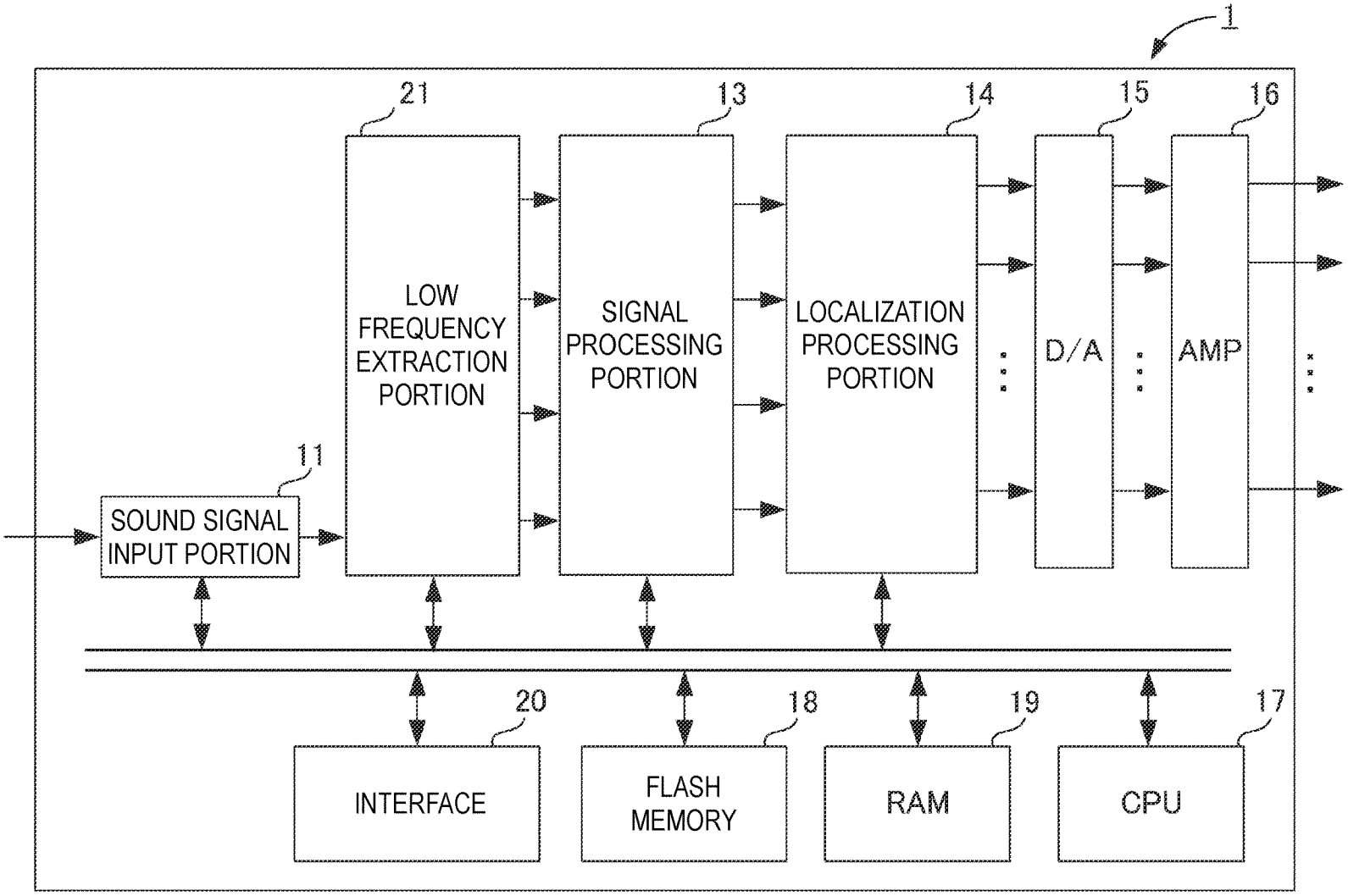
FIG. 8 is a block diagram showing the structure of the sound signal processor according to another embodiment of the present invention.

FIG. 8 is a block diagram showing the structure of the sound signal processor 1 according to another embodiment of the present invention. In this embodiment, the sound signal processor 1 further includes a low frequency extraction portion 21. The low frequency extraction portion 21 is configured by a DSP. The low frequency extraction portion 21 extracts low-frequency components of sound signals. The low-frequency components of the sound signals mainly include sounds for getting the rhythm created by, for example, a drum or a guitar. It is preferable that such sounds are outputted from a position (stable position) which is constantly located at the same place, for example, a low place near to a floor in the room. Regarding the low-frequency components of the sound signals, there are cases where sound stability cannot be obtained unless output of the low-frequency components of the sound signals is made from such stable position. For this reason, the low frequency extraction portion 21 previously extracts the low-frequency components of the sound signals, and outputs the low-frequency components of the sound signals and the components other than them to the signal processing portion 13.

The signal processing portion 13 does not perform signal processing in accordance with the timings of the detected beats on the low-frequency components of the sound signals. The signal processing portion 13 outputs the low-frequency components of the sound signals to the localization processing portion 14 without conducting a beat-based signal processing. The localization processing portion 14 distributes the low-frequency components of the sound signals corresponding to the respective sound sources only to the speaker SP8. That is, the low-frequency components of the sound signals are outputted to the subwoofer. In such a structure, the low-frequency components of the sound signals are outputted from a stable position through the subwoofer.

In the above-described embodiment, the sound signals and contents data obtained by the sound signal input portion 11 conform to the object base method. However, the sound signals and contents data that the present invention can handle are not limited thereto. In another embodiment, the sound signals and contents data obtained by the sound signal input portion 11 may conform to a channel base method.

Figure 9:
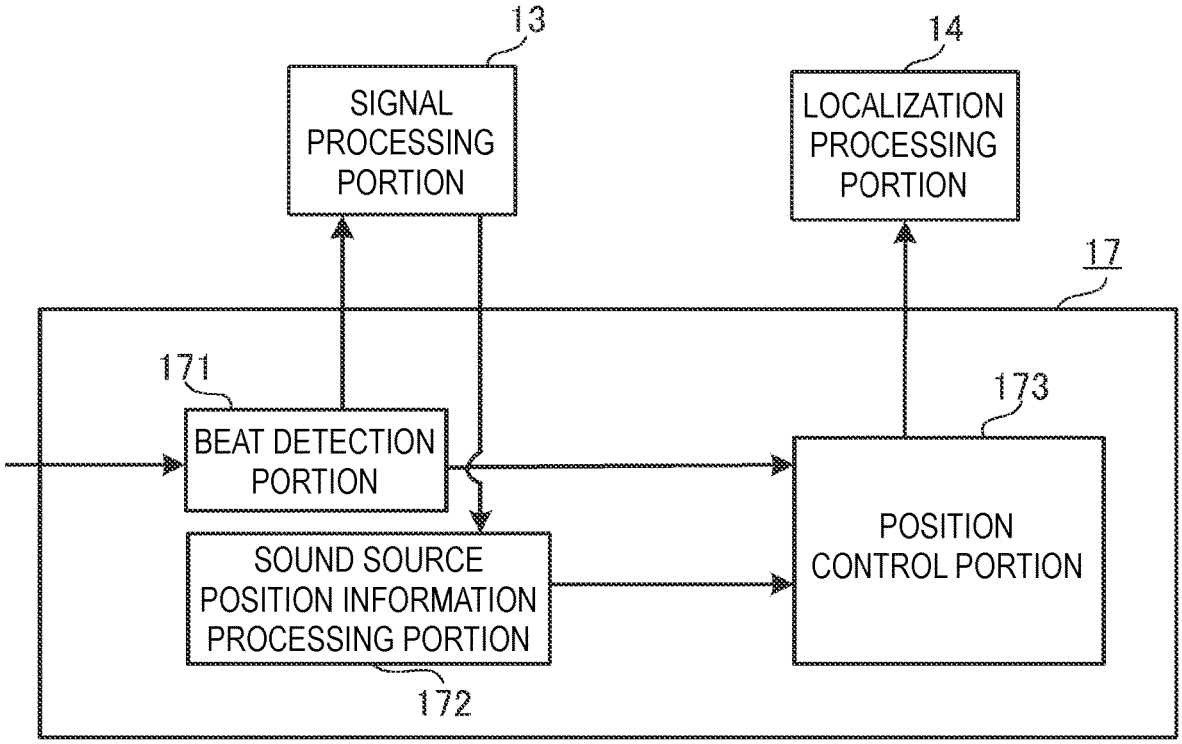
FIG. 9 is a block diagram showing the functional structure of the CPU according to another embodiment of the present invention.

FIG. 9 is a block diagram showing the functional structure of the CPU 17 according to another embodiment of the present invention. In a case where the inputted sound signals and contents data conform to the channel base method, the signal processing portion 13 having obtained sound signals from the sound signal input portion 11 and the decoder analyzes the sound signals and extracts the position information of the sound sources before performing signal processing. In this case, the sound source position information processing portion 172 obtains the position information of the sound sources from the signal processing portion 13.

The signal processing portion 13 calculates, for example, the level of the sound signal of each of channels and the cross-correlation between the channels. The signal processing portion 13 estimates the position of the sound source based on the level of the sound signal of each of the channels and the cross-correlation between the channels. For example, in a case where the correlation value between the L channel and the SL channel is high and the level of the L channel and the level of the SL channel are high (exceed a predetermined threshold value), the signal processing portion 13 estimates that a sound source is present between the L channel and the SL channel. The signal processing portion 13 estimates the position of the sound source based on the level of the L channel and the level of the SL channel. For example, when the ratio between the level of the L channel and the level of the SL channel is 1:1, the signal processing portion 13 estimates that the position of the sound source is just at the middle point between the L channel and the SL channel. The larger the number of channels is, the more accurately the position of the sound source can be estimated. By calculating the correlation value between a multiplicity of channels, the signal processing portion 13 can substantially uniquely identify the position of the sound source.

In a case where the inputted sound signals and contents data conform to the channel base method, the beat detection portion 171 having obtained sound signals from the sound signal input portion 11 and the decoder detects beats on at least one of the sound signals of a plurality of channels. The beat detection portion 171 outputs the result of the beat detection to the signal processing portion 13 in real time or collectively. The signal processing portion 13 performs signal processing such as delay, reverb or equalizer on the sound signals in accordance with the timings of the detected beats.

Further, the position control portion 173 changes the position information of the sound sources in accordance with the timings of the detected beats based on the result of the beat detection. The position control portion 173 outputs the changed position information to the localization processing portion 14. Then, the localization processing portion 14 performs localization processing to localize a sound image, based on the changed position information.

In the above-described embodiment, the sound signal processor 1 continuously performs effect processing on the sound signals conforming to the channel base method. However, the present invention is not limited thereto. Signal processing such as delay, reverb or equalizer or sound source position change may be separately performed on the sound signals conforming to the channel base method.

The descriptions of the present embodiment are illustrative in all respects and not restrictive. The scope of the present invention is shown not by the above-described embodiments but by the scope of the claims. Further, it is intended that all changes within the meaning and the scope equivalent to the scope of the claims are embraced by the scope of the present invention.

What is claimed is:

1. A sound signal processor, comprising:

a memory storing instructions; and a processor configured to implement the stored instructions to execute a plurality of tasks, including:

a sound signal input task configured to obtain a sound signal;

a beat detection task configured to detect a beat in the sound signal; and a processing task configured to perform an effect processing on the sound signal in accordance with a timing of the detected beat, wherein the processing task:

calculates levels of sound signals of a plurality of channels and a cross-correlation between the plurality of channels;

obtains position information about a position of a sound source corresponding to the sound signal based on the levels of the sound signals and the cross-correlation between the plurality of channels;

changes the position information about the position of the sound source in accordance with the timing of the detected beat; and performs a localization processing to localize a sound image based on the changed position information.

2. The sound signal processor according to claim 1, wherein the sound signal input task obtains sound signals corresponding to each of a plurality of sound sources; and wherein the processing task performs the effect processing on the sound signals corresponding to each of the plurality of sound sources.

3. The sound signal processor according to claim 1, wherein the processing task changes the position information about the position of the sound source so that the position of the sound source is virtually rotated about a predetermined axis or so that the position of the sound source is virtually moved upward or downward.

4. The sound signal processor according to claim 1, wherein the processing task further adjusts a volume of the sound signal in accordance with the timing of the detected beat.

5. The sound signal processor according to claim 1, wherein the processing task further replaces the sound signal, which corresponds to a first sound source, with a sound signal corresponding to a second sound source, which is different in kind from the first sound source, in accordance with the timing of the detected beat.

6. The sound signal processor according to claim 1, further comprising:

a filter configured to extract a component in a specific band of the sound signal, wherein the beat detection task performs beat detection on the extracted component in the specific band of the sound signal.

7. The sound signal processor according to claim 1, wherein the beat detection task detects the beat in real time, on the inputted sound signal.

8. The sound signal processor according to claim 1, wherein the plurality of tasks executed by the processor further include:

a low-frequency extraction task configured to extract a low-frequency component of the sound signal, wherein the processing task performs the effect processing on a component of the sound signal other than the low-frequency component of the sound signal in accordance with the timing of the detected beat.

9. The sound signal processor according to claim 1, wherein the sound signal input task obtains sound signals of each of the plurality of channels; and wherein the beat detection task detects the beat in at least one of the sound signals of the plurality of channels.

10. A sound signal processing method, comprising:

obtaining a sound signal;

calculating levels of sound signals of a plurality of channels and a cross-correlation between the plurality of channels;

obtaining position information about a position of a sound source corresponding to the sound signal based on the levels of the sound signals and the cross-correlation between the plurality of channels;

detecting a beat in the sound signal;

performing an effect processing on the sound signal in accordance with a timing of the detected beat such that the position information about the position of the sound source is changed in accordance with the timing of the detected beat; and performing a localization processing to localize a sound image based on the changed position information.

11. The sound signal processing method according to claim 10, wherein in obtaining the sound signal, sound signals corresponding to each of a plurality of sound sources are obtained; and wherein in performing the effect processing, the effect processing is performed on the sound signal corresponding to each of the plurality of sound sources.

12. The sound signal processing method according to claim 10, further comprising:

adjusting a volume of the sound signal in accordance with the timing of the detected beat.

13. The sound signal processing method according to claim 10, further comprising:

replacing the sound signal, which corresponds to a first sound source, with a sound signal corresponding to a second sound source, which is different in kind from the first sound source, in accordance with the timing of the detected beat.

14. The sound signal processing method according to claim 10, further comprising:

extracting a component in a specific band of the sound signal; and performing beat detection on the extracted component in the specific band of the sound signal.

15. The sound signal processing method according to claim 10, wherein in detecting the beat in the sound signal, the beat is detected in real time, on the inputted sound signal.

16. The sound signal processing method according to claim 10, further comprising:

extracting a low-frequency component of the sound signal, wherein in performing the effect processing, the effect processing is performed on a component other than the low-frequency component of the sound signal in accordance with the timing of the detected beat.

17. The sound signal processing method according to claim 10, wherein in obtaining the sound signal, sound signals of each of the plurality of channels are obtained; and wherein in detecting the beat in the sound signal, the beat is detected in at least one of the sound signals of the plurality of channels.

18. An apparatus, comprising:

an interface configured to receive and to output a sound signal;

one or more digital signal processors configured to receive the sound signal output from the interface and to:

calculate levels of sound signals of a plurality of channels and a cross-correlation between the plurality of channels;

obtain position information about a position of a sound source corresponding to the sound signal based on the levels of the sound signals and the cross-correlation between the plurality of channels;

detect a beat in the sound signal;

perform an effect processing on the sound signal in accordance with a timing of the detected beat such that the position information about the position of the sound source is changed in accordance with a timing of the detected beat; and perform a localization processing to localize a sound image based on the changed position information.

* * * * *